US010208757B2

(12) United States Patent
Alger et al.

(10) Patent No.: US 10,208,757 B2
(45) Date of Patent: Feb. 19, 2019

(54) REMOTE FAN OPERATOR

(71) Applicant: International Business Machines Corporation, Armonk, NY (US)

(72) Inventors: Joshua A. Alger, Raleigh, NC (US); David R. Cariello, Durham, NC (US); Sean M. Franklin, Durham, NC (US); Andrew J. Lohr, Cary, NC (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 473 days.

(21) Appl. No.: 14/967,581

(22) Filed: Dec. 14, 2015

(65) Prior Publication Data

US 2017/0167494 A1 Jun. 15, 2017

(51) Int. Cl.
*F04D 25/08* (2006.01)
*F04D 27/00* (2006.01)

(52) U.S. Cl.
CPC ..... *F04D 25/088* (2013.01); *F04D 27/00* (2013.01)

(58) Field of Classification Search
CPC ..... F04D 25/088; E06B 9/326; E06B 9/74; E06B 9/78; E06B 2009/785
USPC ..... 416/5
See application file for complete search history.

(56) References Cited

U.S. PATENT DOCUMENTS

| | | | | |
|---|---|---|---|---|
| 5,189,412 | A | 2/1993 | Mehta et al. | |
| 6,211,632 | B1 * | 4/2001 | Liao | F04D 25/088 318/16 |
| 2006/0044154 | A1 | 3/2006 | Liao | |
| 2016/0130874 | A1 * | 5/2016 | Pham | E06B 9/40 242/615.2 |

FOREIGN PATENT DOCUMENTS

| | | | |
|---|---|---|---|
| CN | 2272956 | Y | 1/1998 |
| GB | 2480476 | A | 11/2011 |
| JP | 2003065579 | A | 3/2003 |

OTHER PUBLICATIONS

Chai Wei Electric Co. Ltd; "Universal Ceiling Fan Remote Control Kit" http://www.amazon.com/Universal-Ceiling-Fan-Remote-Control/dp/B001I1M95E; p. 1.

* cited by examiner

*Primary Examiner* — Richard A Edgar
*Assistant Examiner* — Danielle M. Christensen
(74) *Attorney, Agent, or Firm* — Cantor Colburn LLP

(57) ABSTRACT

An adaptor for providing remote control of a mechanical actuator includes a housing having a bore formed therein for receiving a portion of the mechanical actuator. At least one engagement mechanism extends into the bore such that the at least one engagement mechanism engages the portion of the mechanical actuator. A motor is coupled to the at least one engagement mechanism and a sensor is operably coupled to the motor such that the motor is configured to actuate the mechanical actuator via the at least one engagement mechanism in response to a signal detected by the sensor.

18 Claims, 3 Drawing Sheets

REMOTE FAN OPERATOR

BACKGROUND

Exemplary embodiments of this disclosure relate to a remotely control device, and more particularly, to an adaptor for providing remote control of a home appliance, such as a ceiling fan.

Conventional ceiling fans provide a variety of desired features. Specifically, modern ceiling fans may be controlled to operate at a plurality of different speeds from a relatively low speed to a high maximum speed. Low speeds may be desirable to provide for general air circulation and to eliminate "hot" or "cold" spots within a room. Higher speeds may be desirable to provide a cooling effect or to eliminate temperature gradients. In addition, the direction of rotation of the ceiling fan may be controlled to be in either one of two opposite directions. For example, in winter, it may be desirable to have the fan turn in one direction, creating an updraft, to circulate hot air away from the ceiling, and in the summer, it may be desirable to have the fan town in an opposite direction, creating a down draft, to provide a cooling effect within the room. In addition, ceiling fans are often combined with one or more light fixtures, the intensity level of which may be controlled to operate at a plurality of different levels.

Ceiling fans typically include a mechanical pull chain connected to an electrical switch to start, stop, or change a speed of the ceiling fan. In addition, the ceiling fan may include a centrally disposed light that is similarly be operated by a switch connected to an actuatable pull chain. Because the pull chains are located on the ceiling fan unit itself, a person must walk up to the unit to control the operation of the ceiling fan.

SUMMARY

According to an embodiment of the invention, an adaptor for providing remote control of a mechanical actuator includes a housing having a bore formed therein for receiving a portion of the mechanical actuator. At least one engagement mechanism extends into the bore such that the at least one engagement mechanism engages the portion of the mechanical actuator. A motor is coupled to the at least one engagement mechanism and a sensor is operably coupled to the motor such that the motor is configured to actuate the mechanical actuator via the at least one engagement mechanism in response to a signal detected by the sensor.

According to another embodiment of the invention, a remotely operable home appliance includes a component having a plurality of settings and a mechanical actuator operable to select one of the plurality of settings of the component. An adaptor receives a portion of the mechanical actuator. The adaptor includes at least one engagement mechanism engaged with and configured to apply a force to the mechanical actuator in response to a signal sensed from a remote device.

According to yet another embodiment of the invention, amethod of remotely controlling an appliance includes connecting an adaptor to a portion of a mechanical actuator of the appliance such that at least one engagement mechanism of the adaptor is engaged with the mechanical actuator. A signal generated by a remote device is detected. The signal is processed, and a motor operably coupled to the at least one engagement mechanism is operated to achieve a desired operational setting of the appliance.

The detailed description of the invention describes exemplary embodiments of the invention, together with some of the advantages and features thereof, by way of example with reference to the drawings.

DETAILED DESCRIPTION

Figure 1:
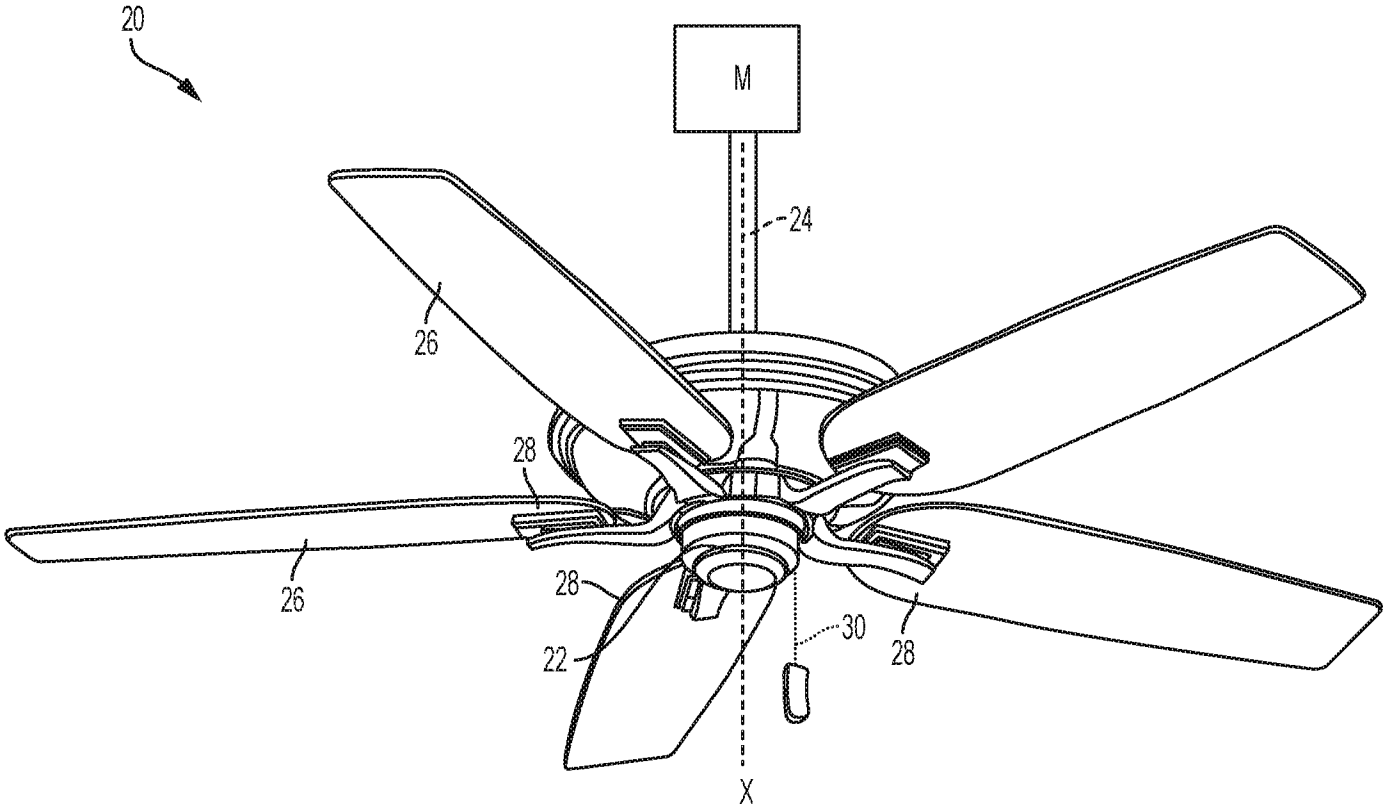
FIG. 1 is a perspective viewof an example of a ceiling fan operated by a mechanical actuator.

Referring now to FIG. 1, an example of a home appliance 20 having a mechanical actuator, such as a ceiling fan, is illustrated in more detail. As shown, a conventional ceiling fan 20 includes a hub 22 mounted to a rotatable shaft 24. At least two fan blades 26 are mounted at a first end 28 and extend outwardly from the hub 22. Although five fan blades 26 are shown in the non-limiting embodiment of FIG. 1, a ceiling fan 20 having any number of fan blades 26 is within the scope of the disclosure. A motor, illustrated schematically at M, is coupled to the shaft 24 and is configured to drive rotation of the shaft 24 and hub 22 about an axis of rotation X. This rotational motion produced by the motor M will circulate air via rotational movement of the fan blades 26. In order to control the speed of rotation of the fan blades 26, the motor may include a control switch (not shown) which is operable via a mechanical actuator 30, such as by applying a force to a pull chain for example, to select between an "off condition" and high speed, medium speed, and low speed "on conditions." In embodiments where the ceiling fan 20 includes an integrally formed light fixture, the ceiling fan 20 may additionally include another mechanical actuator, such as a second pull chain for example (not shown), to control operation of the light.

Figure 2:
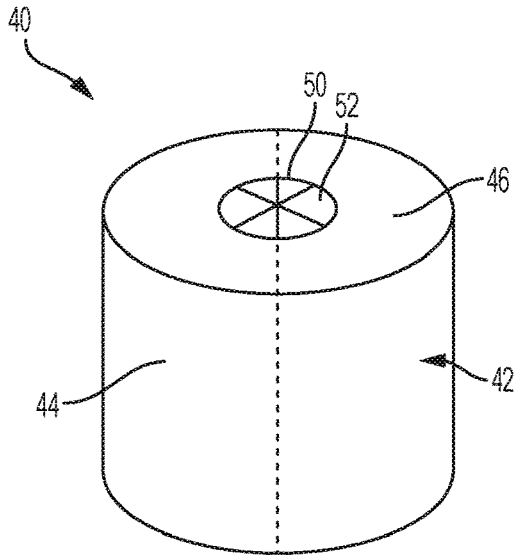
FIG. 2 is a perspective view of an adaptor for remotely controlling a mechanical actuator according to an embodiment.
Figure 3:
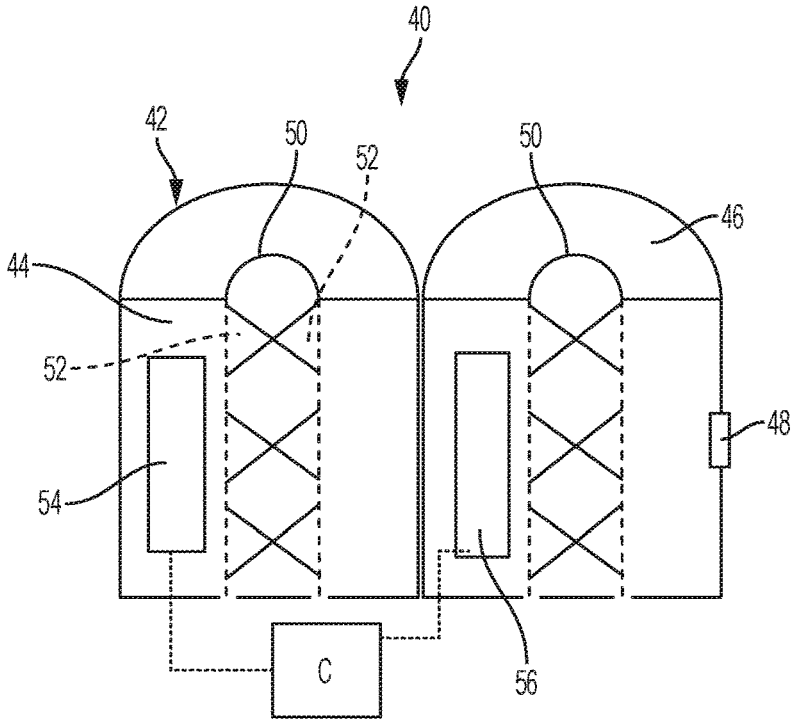
FIG. 3 is a perspective view of an adaptor for remotely controlling a mechanical actuator in an open position according to an embodiment.
Figure 4:
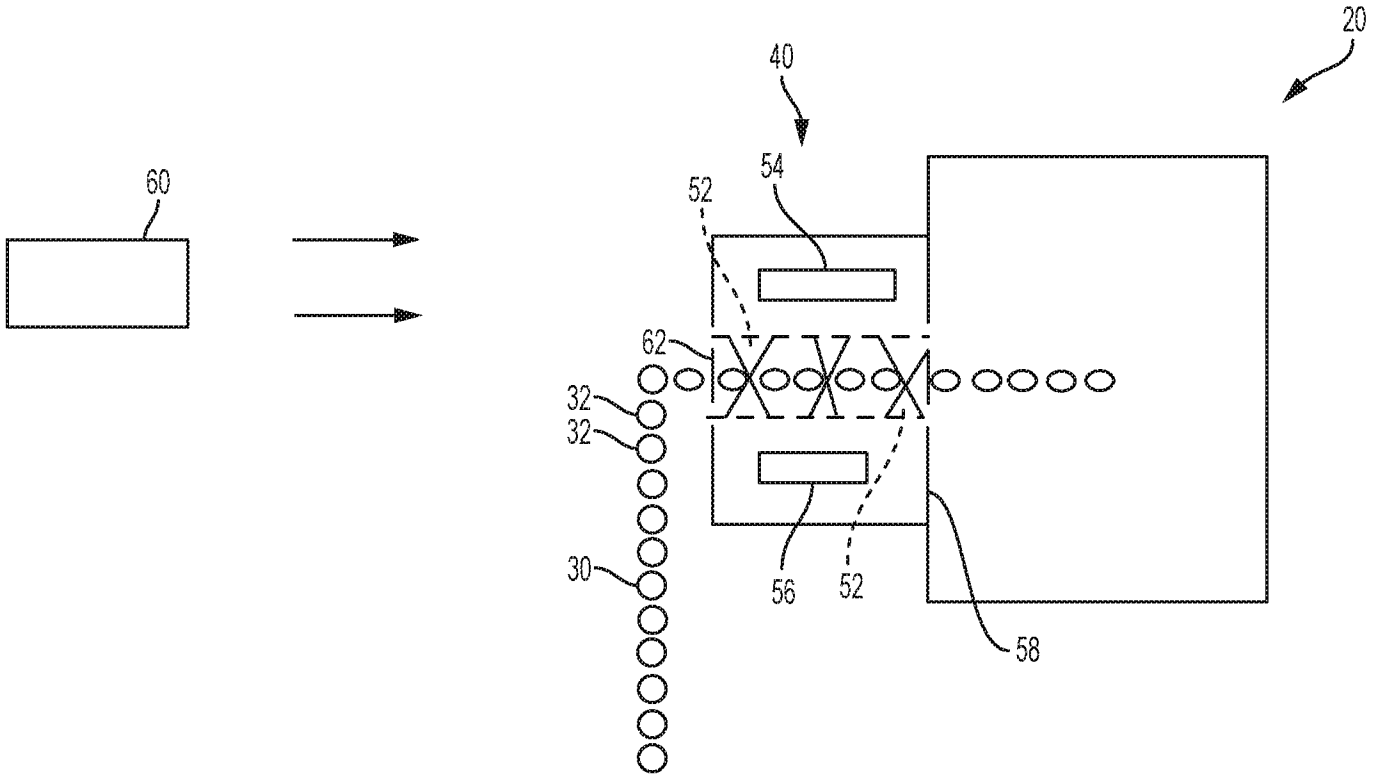
FIG. 4 is a side view of an adaptor for remotely controlling a mechanical actuator coupled to a mechanical actuator of an appliance according to an embodiment.

Referring now to FIGS. 2-4. an example of an adaptor 40 configured for use with a mechanical actuator 30, such as the pull chain of the ceiling fan 20 of FIG. 1 for example, is illustrated. The adaptor 40 includes a housing 42 having a first section 44 and a second section 46 configured to move, for example via a hinge, between a closed position (FIG. 2) and an open position (FIG. 3). Although the housing 42 as illustrated is generally cylindrical in shape, a housing 42 having any shape or configuration is within the scope of the disclosure. In one embodiment, the housing 42 includes a retaining mechanism 48, such as a clasp for example, for selectively retaining the first section 44 and second section 46 of the housing 42 together in the closed position. The retaining mechanism 48 may additionally be configured to release one of the first section 44 and the second section 46, thereby allowing the housing 42 to pivot to an open position.

A bore 50 extends through a generally central portion of the housing 42 such that a portion of the bore 50 is formed in both the first section 44 and the second section 46 thereof. However, in other embodiments, the bore 50 may be offset from a center such that the bore 50 is positioned in only one of the first section 44 and the second section 46 of the housing 42. The bore 50 is configured to receive a portion of a mechanical actuator 30, such as the pull chain of a ceiling fan 20 for example. As a result, a diameter of the bore 50 is substantially equal to or slightly larger than a diameter of a corresponding portion of the mechanical actuator 30.

As shown in each Figure, at least one engagement mechanism 52 is mounted within the housing 42 and extends into the channel formed by the bore 50. The at least one engagement mechanism 52 is configured to couple to or interact with the portion of the mechanical actuator 30 received therein. In the illustrated, non-limiting embodiment, the at least one engagement mechanism 52 includes a plurality of teeth, such as in an embodiment where the engagement mechanism 52 is a gear. As shown, the mechanical actuator 30 is a beaded pull chain and the teeth 52, positioned between adjacent beads 32 (see FIG. 4), cooperate with one another to grasp the pull chain. Although the at least one engagement mechanism 52 illustrated and described herein includes a plurality of teeth, other engagement mechanisms are also within the scope of the disclosure.

A motor 54 disposed within the housing 42 is operably coupled to the at least one engagement mechanism 52. Operation of the motor 54 causes the at least one engagement mechanism 52 to move, thereby applying a force to the mechanical actuator 30 in a manner similar to human operation. The adaptor 40 additionally includes a sensor 56 capable of receiving one or more operating signals from a remotely located device. The sensor 56 may be configured to receive any of a plurality of signal types, including but not limited to, infrared, radio frequency identifier, Bluetooth, local area network, wireless, and near field communication for example. A controller arranged in communication with both the sensor 56 and the motor 54, illustrated schematically at C (FIG. 3), is configured to process a signal and initiate corresponding operation of the motor 54 in response thereto.

With reference now to FIG. 4, an example of the adaptor 40 attached to a mechanical actuator 30 is illustrated in more detail. As shown, the pull chain 30 of the ceiling fan 20 is positioned within the bore 50 and the housing 42 is closed around the pull chain 30. A first end 58 of the adaptor 40 may be arranged in contact with an adjacent portion of the ceiling fan 20 not only to provide leverage when the adaptor 40 is operated, but also to minimize the appearance of the adaptor 40 relative to the mechanical actuator. To operate the mechanical actuator 30, such as to turn on or adjust a speed of the ceiling fan 20 for example, a signal is sent from a remote device 60 to the sensor 56 of the adaptor 40. The remote device 60 used to generate the signal may be a remote control, a home automation system, or an application operable on a smart device, such as a phone or tablet for example. The remote devices 60 listed herein are intended only as examples, and it should be understood that other types of remote devices 60 are also within the scope of the disclosure.

In response to the signal from the remote device 60, the motor 54 drives movement of the at least one engagement mechanism 52 coupled to the mechanical actuator 30. As the at least one engagement mechanism 52 moves, it applies a force to the mechanical actuator 30, specifically to the pull chain in a direction towards a second end 62 of the adaptor 40. The force applied to the mechanical actuator 30 operates a control switch (not shown), causing a change in the operational settings of the motor M driving rotation of the shaft 24 and hub 22 about the axis of rotation X. Although the adaptor 40 is illustrated and described herein with respect to operation of a ceiling fan 20, variations of the adaptor 40 for use with other appliances having a mechanical actuator 30 are also considered within the scope of the disclosure.

By operating a mechanical actuator 30 in response to an electrical signal, the adaptor 40 illustrated and described herein may be used to adapt a conventional appliance into a "smart appliance" that may be controlled remotely, such as with a phone or other smart device. As a result, the controllability of the adaptor 40 is more efficient and will no longer require manual interaction by an operator.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. An adaptor for providing remote control of a mechanical actuator of an appliance, the mechanical actuator comprising a first portion within the appliance and a second portion at an exterior of the appliance, the adaptor comprising:

a housing comprising a first end and a second end opposite the first end;

a bore formed in the housing to extend longitudinally from the first end to the second end, the first end of the housing being arranged in contact with an adjacent portion of the appliance such that:

the bore is receptive of a first section of the second portion of the mechanical actuator, which is proximal to the first portion, the first section of the second portion is co-linear with the first portion, and a second section of the second portion is remote from the first portion and is oriented perpendicularly relative to the first section at an exterior of the housing;

at least one engagement mechanism extending into the bore such that the at least one engagement mechanism engages the first section of the second portion of the mechanical actuator;

a motor coupled to the at least one engagement mechanism; and a sensor operably coupled to the motor, such that the motor is configured to actuate the mechanical actuator via the at least one engagement mechanism in response to a signal detected by the sensor.

2. The adaptor according to claim 1, wherein the at least one engagement mechanism includes a plurality of teeth configured to cooperate to couple to said mechanical actuator.

3. The adaptor according to claim 2, wherein the mechanical actuator includes a pull chain including a plurality of beads.

4. The adaptor according to claim 3, wherein the pull chain is a portion of a ceiling fan and the second section hangs downwardly from an end of the first section at the exterior of the housing.

5. The adaptor according to claim 1, wherein a controller is configured to process the signal detected by the sensor and initiate a corresponding operation of the motor.

6. The adaptor according to claim 1, wherein the housing includes a first section and a second section, the first section being movable relative to the second section such that the housing is transformable between a closed position and an open position.

7. The adaptor according to claim 6, wherein the bore is formed in both the first section and the second section.

8. The adaptor according to claim 1, wherein a remote control is configured to communicate with the sensor through at least one of infrared, radio frequency identification, Bluetooth, local area network, wireless communication, and near field communication.

9. A remotely operable home appliance, comprising:

a component including a plurality of settings;

a mechanical actuator operable to select one of the plurality of settings of the component, the mechanical actuator comprising a first portion within the component and a second portion at an exterior of the component; and an adaptor arranged in contact with the component and within which a first section of the second portion of the mechanical actuator is received such that:

the first section of the second portion is proximal to the first portion, the first section of the second portion is co-linear with the first portion, and a second section of the second portion is remote from the first portion and is oriented perpendicularly relative to the first section at an exterior of the housing, the adaptor including at least one engagement mechanism engaged with and configured to apply a force to the first section of the second portion of the mechanical actuator in response to a signal sensed from a remote device.

10. The remotely operable home appliance according to claim 9, wherein the adaptor includes a controller operably coupled to a sensor and a motor disposed within a housing, wherein the controller processes the signal received by the sensor and initiates a corresponding operation of the motor.

11. The remotely operable home appliance according to claim 10, wherein the motor is configured to drive movement of the at least one engagement mechanism to apply the force to the mechanical actuator.

12. The remotely operable home appliance according to claim 10, wherein the at least one engagement mechanism includes a plurality of teeth.

13. A method of remotely controlling an appliance, comprising:

arranging an adapter in contact with a component comprising a mechanical actuator, the mechanical actuator comprising a first portion within the component and a second portion at an exterior of the component, the second portion comprising a first section, which is proximal to the first portion, and a second section, which is remote from the first portion, the arranging comprising:

receiving the first section within the adapter such that the first section is co-linear with the first portion and the second section is oriented perpendicularly relative to the first section at an exterior of the adapter;

engaging at least one engagement mechanism of the adaptor with the first section;

detecting a signal generated by a remote device;

processing the signal; and operating a motor operably coupled to the at least one engagement mechanism to achieve an operational setting of the appliance.

14. The method according to claim 13, wherein the adaptor is arranged directly adjacent another component of the appliance.

15. The method according to claim 13, wherein operating the motor causes the at least one engagement mechanism to apply a force to the mechanical actuator.

16. The method according to claim 13, wherein the first section of the second portion of the mechanical actuator is received within a bore formed in the adaptor.

17. The method according to claim 16, further comprising closing a housing of the adaptor about the mechanical actuator.

18. The method according to claim 17, wherein a retaining mechanism selectively retains a first section of the housing in contact with a second section of the housing.

* * * * *